US006227003B1

(12) United States Patent
Smolinsky

(10) Patent No.: US 6,227,003 B1
(45) Date of Patent: May 8, 2001

(54) REVERSE-CYCLE HEAT PUMP SYSTEM AND DEVICE FOR IMPROVING COOLING EFFICIENCY

(76) Inventor: David Smolinsky, 3841 Seminole Ave., Ft. Myers, FL (US) 33916

( * ) Notice: Subject to any disclaimer, the term of this patent is extended or adjusted under 35 U.S.C. 154(b) by 0 days.

(21) Appl. No.: 09/426,780

(22) Filed: Oct. 22, 1999

(51) Int. Cl.[7] ..... F25B 13/00
(52) U.S. Cl. ..... 62/324.1
(58) Field of Search ..... 62/324.1, 324.6, 62/324.4

(56) References Cited

U.S. PATENT DOCUMENTS

| | | | | |
|---|---|---|---|---|
| Re. 30,745 | | 9/1981 | Chambless . | |
| 4,030,315 | | 6/1977 | Harnish . | |
| 4,106,307 | * | 8/1978 | Matsuda | 62/324 |
| 4,711,094 | * | 12/1987 | Ares et al. | 62/324.1 X |
| 4,800,736 | * | 1/1989 | Weber | 62/324.1 |
| 5,136,855 | * | 8/1992 | Lenarduzzi | 62/324.4 X |
| 5,771,699 | | 6/1998 | Ponder . | |
| 5,848,537 | * | 12/1998 | Biancardi et al. | 62/324.6 |
| 5,852,939 | * | 12/1998 | Gazes | 62/324.6 X |
| 5,937,670 | * | 8/1999 | Derryberry | 62/324.4 |

OTHER PUBLICATIONS

Althouse et al.; Modern Refrigeration and Air Conditioning; The Goodheart–Willcox Co. Inc.; p141,675,769 et al.; Library of Congress 95–45240, 1996.*

* cited by examiner

*Primary Examiner*—Corrine McDermott
*Assistant Examiner*—Chen-Wen Jiang
(74) *Attorney, Agent, or Firm*—Laura G. Barrow

(57) ABSTRACT

An improved reverse-cycle heat pump system is disclosed that comprises components to improve the efficiency of the system in the cooling mode. Specifically, the invention incorporates a conduit assembly for carrying refrigerant from one heat exchanger to the other heat exchanger, wherein the heat exchangers are configured to function interchangeably as a condenser and evaporator, depending upon whether the system is operating in cooling mode or heating mode. The conduit assembly includes a coiled section of tubing disposed near the heat exchanger that functions as an evaporator in cooling mode. This coiled section functions as a reservoir for collecting excess refrigerant liquid from the "evaporator" during operation of the system in the cooling mode. Consequently, in cooling mode, heat dissipation via the condenser is thereby increased since less refrigerant liquid is contained therein, resulting in improved cooling of the conditioned area or substance (i.e. room air, industrial liquids, water, etc.).

7 Claims, 2 Drawing Sheets

REVERSE-CYCLE HEAT PUMP SYSTEM AND DEVICE FOR IMPROVING COOLING EFFICIENCY

BACKGROUND OF THE INVENTION

The present invention is directed to an improved reverse-cycle heat pump system, and more specifically, to a reverse-cycle heat pump system comprising components that render the system more efficient in cooling during operation in the cooling mode.

Conventional reverse-cycle heat pump refrigeration systems comprise two reversible heat exchangers. One heat exchanger is placed in the space to be heated or cooled and the other heat exchanger is placed outside that space. In the heating mode, the inside heat exchanger functions as the condenser while the outside heat exchanger functions as the evaporator. In cooling mode, the roles are reversed (i.e. the inside heat exchanger functions as the evaporator and the outside heat exchanger functions as the condenser). The heat exchangers are connected to one another by a series of conduits or circuits through which refrigerant is pumped via a motorized compressor. A four-way valve is disposed within the series conduits and functions to direct the flow of refrigerant from the compressor to the appropriate heat exchanger. While the direction of refrigerant through the compressor always flows in one direction, the flow of refrigerant may change direction throughout the rest of the system depending upon whether the system is operating in the heating mode or cooling mode.

In heating mode, the compressor pumps hot, high-pressure refrigerant gas to the indoor heat exchanger, or "condenser," where the gas is condensed into a high pressure liquid as it gives off latent heat of condensation into the conditioned area. The high-pressure liquid then flows out of the condenser through a conduit or series of conduits and enters the outdoor exchanger, or "evaporator," as a low pressure liquid, wherein it absorbs latent heat from the outside and vaporizes. Low pressure refrigerant gas then exits the evaporator and returns to the compressor to begin the cycle again. Heating of the conditioned space is further aided by a fan positioned behind the condenser to blow heated air therein. A fan disposed behind the evaporator aids in drawing in heat from the outside into the system.

In cooling mode, the compressor pumps hot, high-pressure refrigerant gas in the reverse direction to the outdoor heat exchanger (i.e. "condenser") where the refrigerant gas is condensed into a high pressure liquid as it gives off latent heat of condensation to the outside. The resulting high-pressure refrigerant liquid then flows out of the condenser through a conduit or series of conduits and enters the indoor heat exchanger (i.e. "evaporator") wherein it absorbs latent heat from the area to be conditioned and consequently vaporizes. Cooling of the conditioned space is further aided by a fan positioned behind the evaporator to blow cooled air therein. A fan disposed behind the condenser aids in removing heat from the interior of the system.

A major disadvantage inherent in reverse cycle heat pumps is that the efficiency of the system in cooling mode is about 60% compared to that of the heating mode. The reason for this inefficiency is that it takes a much greater pressure drop on the condenser side of the system to dissipate the heat therefrom than it does to absorb heat from the evaporator side. Thus, in heating mode, a greater refrigerant charge is therefore necessary to heat a desired area; however, in the cooling mode, it is more difficult to dissipate the heat generated within the condenser to the outside, where temperatures are presumably already over 80° F. Stated another way, there is generally more refrigerant within the system than needed to cool the inside air or water in a given area. Moreover, this higher refrigerant charge will tend to generate more heat within the heat pump system, thereby diminishing the cooling effect of the evaporator.

Prior art reverse cycle heat pump systems attempt to improve cooling mode efficiency by employing complex double heat exchangers with check valves. Such devices add a significant monetary cost to the product. It is therefore desirable to have a reverse-cycle heat pump system that accomplishes greater cooling efficiency in cooling mode without compromising the heating efficiency in heating mode, whereby the heat pump system employs components of minimal complexity and cost.

SUMMARY

The present invention, in certain aspects, is directed to an improved reverse cycle heat pump refrigeration system that employs components that improve the cooling efficiency of the system. In particular, the present invention, in certain embodiments, comprises (a) a compressor and (b) a first heat exchanger and a second heat exchanger, wherein each of the heat exchangers is adapted to function interchangeably as an evaporator and a condenser, depending upon whether the system is operating in cooling mode or heating mode. The heat exchangers are disposed within the system such that in cooling mode, the first heat exchanger functions as a evaporator and the second heat exchanger functions as an condenser, and wherein in heating mode, the first heat exchanger functions as an condenser while the second heat exchanger functions as a evaporator. The system further includes (c) at least one first conduit in communication with the compressor and each of the heat exchangers, the conduit being adapted for carrying refrigerant through the system to each of the heat exchangers, wherein the conduit also includes a return conduit for carrying refrigerant gas back to the compressor, (d) a valve in communication with the one or more conduits and configured to reverse the flow of refrigerant from the compressor to the heat exchangers depending upon whether the system is operating in a cooling mode or a heating mode and (e) a second conduit connecting the heat exchangers. The second conduit includes (i) a refrigerant metering device disposed near the second heat exchanger, and (ii) a coiled section disposed near the first heat exchanger, wherein the coiled section is adapted for containing any excess refrigerant liquid that may back up from the first heat exchanger therein when the system is operating in cooling mode (i.e. the first heat exchanger is functioning as an evaporator). Specifically, the coiled section is positioned near the refrigerant-entry end of the evaporator in cooling mode.

The inventive system is thereby designed such that when the system is operating in heating mode, the valve is activated to direct refrigerant pumped from the compressor through one or more conduits to the second heat exchanger where the refrigerant gas is condensed into liquid, through the second conduit to the first heat exchanger where the liquid is vaporized into gas, and back to the compressor via the return conduit. In cooling mode, the inventive system is designed such that the valve is activated to direct refrigerant pumped from the compressor through the one or more conduits to the first heat exchanger where the refrigerant gas is condensed into liquid, through the second conduit to the second heat exchanger where the liquid is vaporized into gas, and back to the compressor via the return conduit.

In certain aspects of the invention, the second conduit further includes a reverse direction filter dryer disposed between the metering device and coiled section of the second conduit. Preferably, the metering device of the second conduit is an orifice coupler connected to, and in communication with, the second conduit. The coiled section of the second conduit has a refrigerant carrying capacity substantially equivalent to the refrigerant carrying capacity of the first heat exchanger.

The present invention is also directed to the inventive conduit assembly for installation on a reverse-cycle heat pump refrigeration system and comprises a conduit or tubing having a first end for installation into a first heat exchanger of a reverse-cycle heat pump refrigeration system and a second end for installation into a second heat exchanger of the reverse-cycle heat pump refrigeration system, wherein the second heat exchanger is configured to function as an evaporator when the system is operating in cooling mode and as a condenser wherein the system is operating in heating mode. The conduit assembly includes a metering device disposed near the first end of the conduit, the metering device being connected to, and in communication with, the conduit. A preferred metering device is an orifice coupler having a narrow orifice diameter ranging preferably from 0.120 inches to 0.25 inches. The conduit further has a coiled section disposed near the second end, the coiled section adapted to contain any excess refrigerant liquid that may back up from the second heat exchanger therein during operation of the system in cooling mode. The assembly also includes a filter dryer disposed between the orifice coupler and the coiled section of the conduit.

Figure 1:
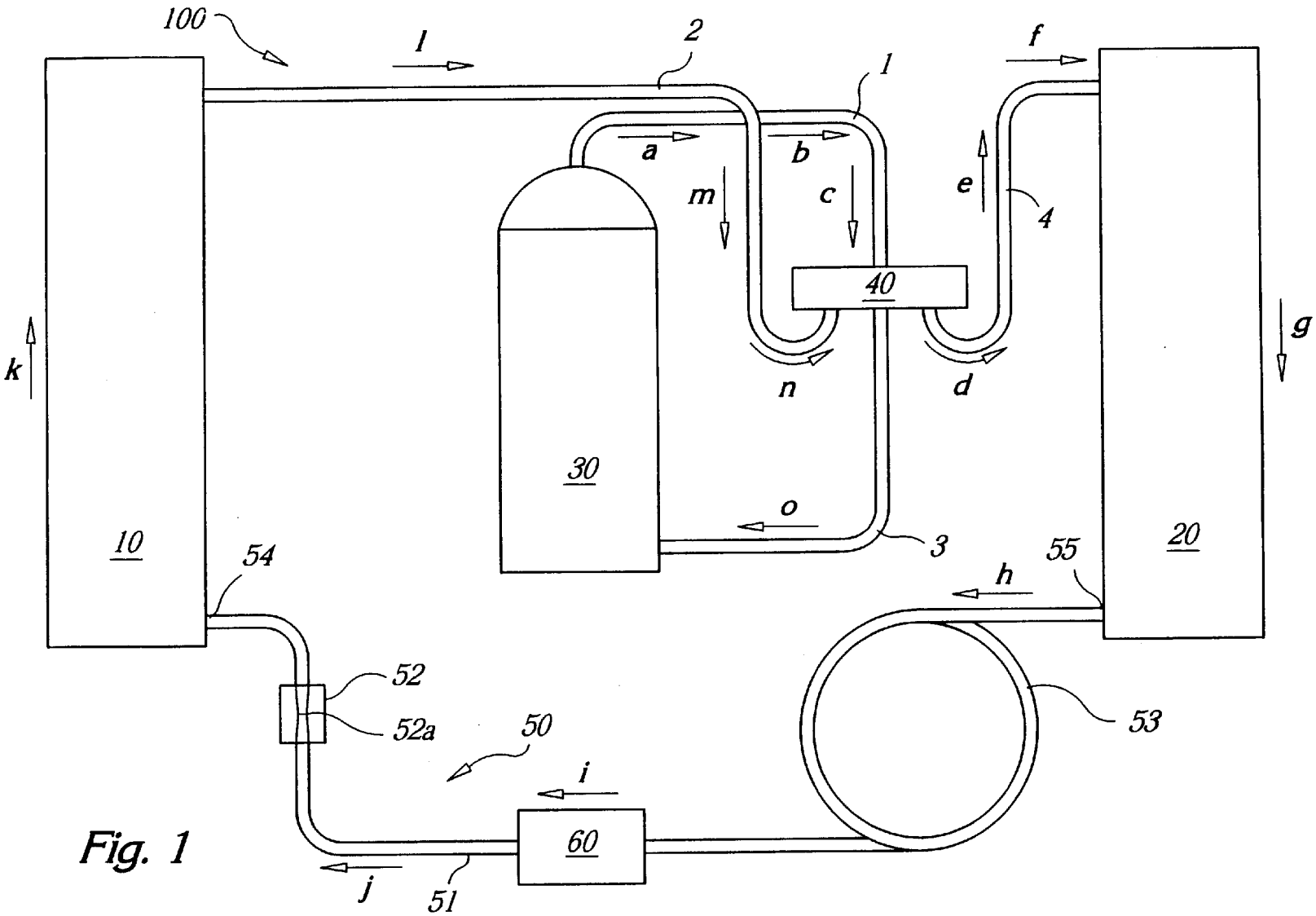
FIG. 1 is a schematic interior top view of a reverse-cycle heat pump system of the present invention, with the arrows showing operation of the system in the heating mode (i.e. flow of refrigerant).
Figures 2, 3:
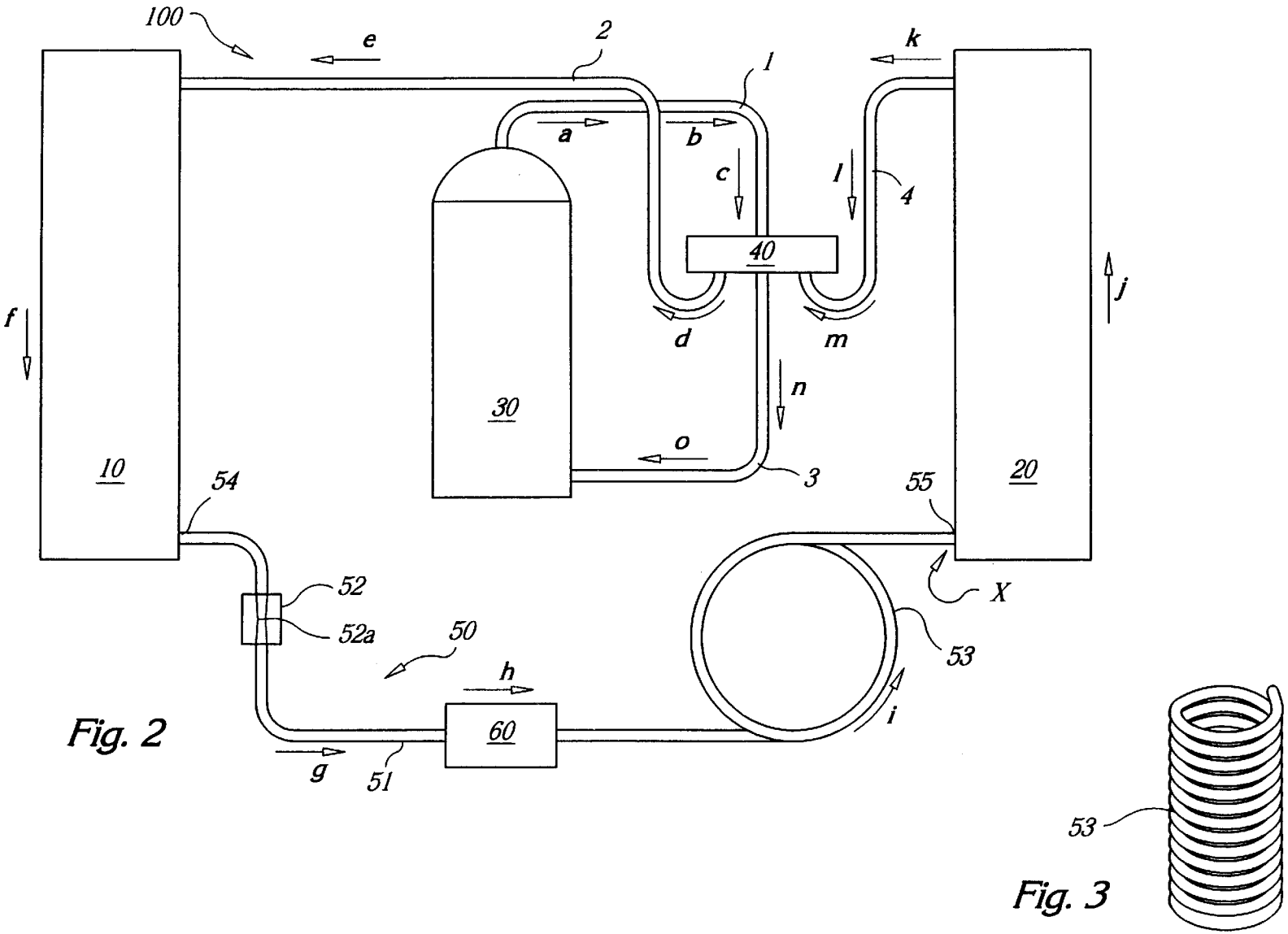
FIG. 2 is a schematic interior top view of a reverse-cycle heat pump system of the present invention, with the arrows showing operation of the system in the cooling mode (i.e. flow of refrigerant).
FIG. 3 is a side view of the coiled section of the conduit assembly.

DETAILED DESCRIPTION OF THE PREFERRED EMBODIMENTS:

Referring now to the figures, the present invention is a reverse-cycle heat pump refrigeration system, generally indicated at 100, that preferably employs many similar components of conventional reverse-cycle heat pumps. Such components include a compressor (30), two heat exchangers (10, 20) designed to function interchangeably as an evaporator and condenser, a plurality of conduits (1–4, 50), and a valve (40) that functions to control the direction of refrigerant (not shown) pumped from the compressor (30) within the system (100). In FIGS. 1–2, heat exchanger (20) operates to heat or cool the air (e.g. building interior) or substance (e.g. industrial liquids, swimming pool or spa, fish tank, etc.) to be conditioned. Thus, in "cooling mode," heat exchanger (20) functions as the evaporator while heat exchanger (10) functions as the condenser. In "heating mode," the roles are reversed—that is, heat exchanger (20) functions as the condenser while heat exchanger (10) functions as the evaporator. Also, the heat exchangers (10, 20) may be any conventional type commonly known by those of ordinary skill in the art, including air-to-air, air-to-liquid, liquid-to-air, and liquid-to-liquid heat exchangers.

FIGS. 1 and 2 illustrate, via arrows (a–o), the path of the refrigerant during operation of the system in heating mode and cooling mode, respectively. As discussed above, in heating mode, heat exchanger (20) functions as the condenser while heat exchanger (10) operates as the evaporator. Conversely, in cooling mode, heat exchanger (20) functions as the evaporator while heat exchanger (10) functions as the condenser. Refrigerant liquid is compressed and pumped from the compressor (30) through a first conduit (1) connected thereto and passes through a valve (40) that functions to direct the flow of the refrigerant to the appropriate heat exchanger, depending upon whether the system is operating in a heating mode or a cooling mode. In the heating mode, as shown in FIG. 1, the valve (40) diverts the high pressure refrigerant gas to a conduit (4) leading to heat exchanger (20), which in heating mode functions as the condenser, as discussed above. Here, heat from the refrigerant gas is released into the conditioned area or substance (e.g. industrial liquids, water, or indoor air), resulting in condensation of the high pressure refrigerant gas into a high pressure liquid. The refrigerant liquid exits the condenser (20) and travels through the conduit assembly (50), discussed in more detail below, and then enters heat exchanger (10), which is functioning as the evaporator in this mode. Here, heat is absorbed from outside the system and into the "evaporator" (10), thereby vaporizing the refrigerant liquid contained therein into a low pressure gas. The refrigerant gas then exits the evaporator (10) through conduit (2) and is diverted to the return conduit (3) via the reversing valve (40) to the compressor (30).

In the cooling mode, as shown in FIG. 2, the valve (40) diverts the high pressure refrigerant gas exiting the compressor (30) via conduit (1) to conduit (2) leading to heat exchanger (10), which in cooling mode now functions as the condenser. The resulting condensed high pressure liquid exits the condenser (10) through the conduit assembly (50) and enters the refrigerant-entry end (x) of the heat exchanger (20), which now functions as the evaporator. Here, heat is absorbed from the conditioned area or substance (e.g. industrial liquid, water, or indoor air), resulting in vaporization of the refrigerant liquid into gas. The low pressure refrigerant gas exits the evaporator (20) through conduit (4) and returns to the compressor (30) via conduit (3). Note that while the path of the refrigerant between heat exchangers may be reversed, the direction of refrigerant flow to and from the compressor (30) is always the same, regardless of the operation mode.

Not shown in the figures but present in many reverse-cycle heat pumps are fans or blowers located behind the heat exchangers (10, 20) to facilitate either removal or flow of heat from or to the system or the cooling of the area or liquid to be conditioned. Such fans may also be employed in the present invention.

When cooling of water or the interior of a building, for example, is desired by using a reverse-cycle heat pump (FIG. 2), a lower refrigerant charge is needed on the low pressure evaporator side for sufficient cooling. In fact, where room air or liquid temperatures are less than 80° F., not all of the refrigerant flowing through the evaporator (20) (FIG. 2) is vaporized, resulting in an excess of liquid refrigerant. Without the provision of some diversion mechanism, this excess liquid refrigerant will flood the condenser, rendering the heat pump system less effective in removing heat through the condenser. Thus, the less refrigerant flowing through the condenser at any given time allows for more efficient heat dissipation from the condenser since there is less high pressure refrigerant gas to be condensed.

To compensate for this excess liquid refrigerant that may occur under such conditions (e.g. where room air or liquid temperatures are below 80° F.), the reverse cycle heat pump system (100) of the present invention incorporates a novel feature that improves the efficiency of the system in the cooling mode, namely a conduit assembly (50) comprising a coiled section (53) positioned adjacent the heat exchanger (20), wherein the coiled section (53) serves as a reservoir for collecting any excess refrigerant liquid that backs up from the evaporator/heat exchanger (20) Specifically, the coiled section (53) is positioned near the refrigerant-entry end (X) of the evaporator (20) (cooling mode). "Refrigerant-entry end" shall mean the end of the heat exchanger (20) through which refrigerant enters when the heat pump system is operating in cooling mode. Preferably, the conduit assembly (50) includes a length of tubing or conduit (51) having one end (54) connected to heat exchanger (10) and the other end (55) connected to heat exchanger (20). Positioned just adjacent heat exchanger (20), the tubing or conduit (51) includes a coiled section (53) as discussed above that collects any excess refrigerant liquid from the heat exchanger (20), as shown in FIGS. 1–3. The diameter and total length of the coiled section (53) should be sufficiently sized such that it has the same total cubic refrigerant capacity as for heat exchanger (10) (note that as in all conventional heat pump systems, heat exchanger (10) in the present invention has a smaller cubic capacity than heat exchanger (20)). Stated another way, the coiled section (53) has about 100% cubic capacity of heat exchanger (10). Thus, for a 4- to 6-ton heat pump system, the coiled section (53) comprises about 15 feet of ⅞ inch diameter tubing. Preferably, the coiled section (53) is enclosed in an insulating material, such as rubber or foam insulation (not shown).

The conduit assembly (50) also incorporates a metering device (52) for balancing the pressure between the two heat exchangers (10, 20). In the preferred embodiment of the present invention, the conduit (51) is connected to an orifice coupler (52) having a narrow orifice (52*a*) centrally disposed therethrough, as shown schematically in FIGS. 1–2. Preferably, the diameter size of the orifice (52*a*) in a 4- to 6-ton heat pump system is a 31 drill size (i.e. 0.120 in.) (in a 12-ton unit the orifice (52*a*) diameter size is about 0.25 in.). Alternatively, the conduit (51) itself may comprise a narrowed diameter corresponding to the "orifice" (52*a*). The conduit assembly (50) may also include a dual direction filter dryer (60) to remove moisture and contaminants from the system; however, the filter dryer (60) may be disposed elsewhere in the system, if desired.

As can be readily appreciated by those of ordinary skill in the art, the present invention is particularly advantageous in its simplicity and consequential reduced cost. No special or additional heat exchangers are required, for example, nor are any complex valve assemblies required other than the conventional reverse valves employed in most reverse-cycle heat pump systems. However, to maximize the cooling efficiency of the present invention, a scroll-type compressor is preferred due to its greater efficiency in compressing refrigerant liquid into a high pressure gas.

Preferably, copper tubing is employed in the conduit assembly (50); however, the skilled artisan will appreciate that other suitable materials used in refrigeration and air conditioning systems may be employed. Finally, any refrigerant commonly used in air refrigeration systems may be used, such as hydroclorofluorocarbons (HCFC) (e.g. R-22).

The foregoing disclosure and description of the invention are illustrative and explanatory thereof, and various changes in the size, shape, and materials, as well as in the details of the illustrated construction may be made without departing from the spirit of the invention.

I claim:

1. A reverse-cycle heat pump refrigeration system comprising:

a. a compressor;

b. a first heat exchanger and a second heat exchanger, each of said heat exchangers adapted to function interchangeably as an evaporator and a condenser, wherein said first heat exchanger functions as an evaporator and said second heat exchanger functions as a condenser when said system is operating in cooling mode, and wherein said first heat exchanger functions as a condenser and said second heat exchanger functions as an evaporator when said system is operating in heating mode;

c. at least one first conduit in communication with said compressor and each of said heat exchangers and adapted for carrying refrigerant through said system to each of said heat exchangers, said at least one conduit including a return conduit for carrying refrigerant gas back to said compressor;

d. a valve in communication with said at least one conduit and configured to reverse the flow of refrigerant from said compressor to said heat exchangers depending upon whether said system is operating in said cooling mode or said heating mode; and e. a second conduit connecting said heat exchangers, said second conduit including (a) an orifice refrigerant metering device disposed near said second heat exchanger, and (b) a coiled section disposed near said first heat exchanger and connected to said first heat exchanger at a refrigerant-entry end of said first heat exchanger, said coiled section further adapted for containing any excess refrigerant liquid that may back up from said first heat exchanger therein during operation of said system in cooling mode;

whereby when said system is operating in heating mode, said valve is activated to direct refrigerant pumped from said compressor through said at least one conduit to said first heat exchanger where said refrigerant gas is condensed into liquid, through said second conduit to said second heat exchanger where said liquid is vaporized into gas, and back to said compressor via said return conduit;

and whereby when said system is operating in cooling mode, said valve is activated to direct refrigerant pumped from said compressor through said at least one conduit to said second heat exchanger where said refrigerant gas is condensed into liquid, through said second conduit and said coiled section of said second conduit, to said first heat exchanger wherein said liquid is vaporized into gas and any excess, non-vaporized refrigerant liquid is collected in said coiled section, and back to said compressor via said return conduit.

2. The system of claim 1, wherein said second conduit further includes a filter dryer disposed between said metering device and said coiled section of said second conduit.

3. The system of claim 1, wherein said metering device has an orifice diameter of from about 0.120 to 0.125 inches.

4. The system of claim 1, wherein said coiled section has a refrigerant carrying capacity substantially equivalent to a refrigerant carrying capacity of said first heat exchanger.

5. A conduit assembly for installation on a reverse-cycle heat pump refrigeration system, said assembly comprising:

a) a conduit having a first end for installation into a first heat exchanger of a reverse-cycle heat pump refrigeration system and a second end for installation into a second heat exchanger of said reverse-cycle heat pump refrigeration system, wherein said first heat exchanger is configured to function as an evaporator when said system is operating in cooling mode and as a condenser when said system is operating in heating mode;

b) an orifice refrigerant metering device disposed near said second end of said conduit, said metering device connected to, and in communication with, said conduit;

c) said conduit having a coiled section disposed near said first end, said coiled section adapted to contain any excess refrigerant liquid that may back up from said first heat exchanger therein during operation of said system in said cooling mode; and d) a filter dryer disposed between said metering device and said coiled section of said conduit.

6. The system of claim 5, wherein said metering device has an orifice diameter of from about 0.120 to 0.125 inches.

7. The system of claim 5, wherein said coiled section has a refrigerant carrying capacity substantially equivalent to a refrigerant carrying capacity of said first heat exchanger.

* * * * *